US010775120B2

(12) United States Patent
Harris et al.

(10) Patent No.: US 10,775,120 B2
(45) Date of Patent: Sep. 15, 2020

(54) AUTOMATIC MAGAZINE EJECTION SYSTEM

(71) Applicant: Evolusion Concepts, Inc., San Diego, CA (US)

(72) Inventors: Courtney Harris, San Diego, CA (US); Glenn Banaag, Los Angeles, CA (US)

(73) Assignee: Adaptive Tactical Solutions, Inc., San Diego, CA (US)

( * ) Notice: Subject to any disclaimer, the term of this patent is extended or adjusted under 35 U.S.C. 154(b) by 0 days.

(21) Appl. No.: 16/687,680

(22) Filed: Nov. 18, 2019

(65) Prior Publication Data

US 2020/0263944 A1 Aug. 20, 2020

Related U.S. Application Data

(63) Continuation-in-part of application No. 15/730,822, filed on Oct. 12, 2017, now Pat. No. 10,480,879, which is a continuation-in-part of application No. 15/676,029, filed on Aug. 14, 2017, now abandoned.

(51) Int. Cl.
*F41A 17/36* (2006.01)
*F41A 17/42* (2006.01)

(52) U.S. Cl.
CPC ..... *F41A 17/36* (2013.01); *F41A 17/42* (2013.01)

(58) Field of Classification Search
CPC ..... F41A 17/36; F41A 17/38; F41A 17/40; F41A 17/42
USPC ..... 42/70.02
See application file for complete search history.

(56) References Cited

U.S. PATENT DOCUMENTS

| | | | | |
|---|---|---|---|---|
| D745,945 | S | 12/2015 | Kielsmeier et al. | |
| 9,222,739 | B1 | 12/2015 | Bennett et al. | |
| 9,383,152 | B2 | 7/2016 | Nakayama et al. | |
| 9,429,378 | B2 | 8/2016 | Bennett et al. | |
| 9,470,464 | B2 | 10/2016 | Kielsmeier et al. | |
| 9,482,480 | B2 | 11/2016 | O'Dell et al. | |
| 9,651,328 | B1 * | 5/2017 | Oglesby | F41A 35/06 |
| 2013/0269232 | A1 | 10/2013 | Harris et al. | |
| 2015/0345882 | A1 | 12/2015 | Nakayama et al. | |
| 2016/0069628 | A1 * | 3/2016 | Fluhr | F41A 17/38 42/6 |
| 2016/0292826 | A1 | 10/2016 | Beall | |
| 2016/0348991 | A1 | 12/2016 | Tisone et al. | |

(Continued)

FOREIGN PATENT DOCUMENTS

WO WO-2017106857 A1 * 6/2017 ..... F41A 3/68

*Primary Examiner* — Stephen Johnson
(74) *Attorney, Agent, or Firm* — Kevin Keener; Keener and Associates P.C.

(57) ABSTRACT

An automatic magazine ejection system is disclosed. The automatic magazine ejection system comprises a modified bolt catch, a release switch, and a pivotable magazine catch. The modified bolt catch pivots from a first position to a second position. When in the second position the bottom of an external part of the modified bolt catch moves toward the firearm. The release switch is connected to the modified bolt catch. The bottom of the release switch engages the end of the pivotable magazine catch to pivot the end of the magazine catch out of the magazine well and permit the automatic removal of the magazine. If the release switch is slid to an "off" position then the bottom of the release switch does not engage the pivotable magazine catch when it moves and the magazine is not removed from the magazine well.

12 Claims, 11 Drawing Sheets

(56) References Cited

U.S. PATENT DOCUMENTS

| | | | | |
|---|---|---|---|---|
| 2016/0348992 | A1 | 12/2016 | Tisone et al. | |
| 2017/0160026 | A1 | 6/2017 | Walther et al. | |
| 2018/0149438 | A1 | 5/2018 | Heaudiuck et al. | |
| 2019/0078850 | A1* | 3/2019 | Cross | F41A 17/38 |

* cited by examiner

AUTOMATIC MAGAZINE EJECTION SYSTEM

PRIORITY

This application is a continuation in part of U.S. patent application Ser. No. 15/730,822, which matured into U.S. Pat. No. 10,480,879, filed on Oct. 12, 2017, which is a continuation in part of U.S. patent application Ser. No. 15/676,029, filed on Aug. 14, 2017, and the disclosures of which are hereby incorporated by reference.

FIELD OF THE INVENTION

This invention pertains generally to ammunition magazines for firearms and more specifically to an automatic magazine ejection system.

BACKGROUND OF INVENTION

Followers are known in the art. A follower is a component situated within a magazine between a lower spring and the ammunition rounds in the magazine. As the rounds are fired from the firearm, the spring pushes the follower up along the body of the magazine, pushing the rounds into the firing chamber for continued firing.

A standard OEM semi-automatic rifle contains a magazine catch assembly. A standard magazine catch assembly is comprised of a magazine catch, a spring, and magazine release button. The magazine catch consists of two ends which occur at a substantially right angle. One end is a threaded screw. The other end is a substantially flat member. When installed in a semi-automatic rifle, the spring is placed over the threaded screw end of the magazine catch. The screw is then inserted through the lower receiver and threaded through the magazine catch button on the opposite side of the lower receiver. The opposite end of the magazine catch rests within a recess in the magazine well receiver. When a magazine is placed in the magazine well the magazine catch slides into a recess in the magazine. The catch holds the magazine in place while the firearm is in use. To release the magazine, a user pushes the magazine release button. When the magazine release button is depressed the magazine catch is lifted from the recess in the magazine and the magazine freely slides out of the magazine well.

When a magazine is empty the user does not know until the user has fired all of the rounds from magazine, including those from the magazine which are in the chamber. So currently when a magazine is empty it is still attached to the lower receiver of the firearm. The user does not become aware that the magazine is empty until the user pulls the trigger and the firearm does not fire. At this point in time then the user pushes the magazine release button. The magazine release button is attached to the magazine catch bar. The magazine catch bar resides in a catch recess in the magazine which prevents the magazine from being removed. Once the magazine catch bar is disengaged then the user removes the empty magazine and replaces it with a full magazine to continue firing.

This process is inefficient. A user is unable to fire the firearm while removing the magazine and attaching a new magazine. What is needed is a device and method whereby the magazine is automatically ejected from the firearm after the last round has left the magazine. This would increase the efficiency of use because the user does not have to remove the empty magazine but instead can simply insert the new magazine and continue firing.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof Its sole purpose is to present some concepts in a simplified form as a prelude to the more detailed description that is presented later.

The invention is directed toward an automatic magazine ejection system for a fire arm. The invention comprises a modified bolt catch having a bolt stop portion, an external portion, and an angled connection point connecting said bolt stop portion and said external portion; wherein said bolt stop portion is disposed in an internal chamber in a receiver of said firearm; wherein said external portion is disposed externally from said internal chamber of said firearm, said external portion having a top portion and a bottom portion; wherein said bolt stop portion has a bottom side and a bolt surface; a release switch comprising a magazine catch lever disposed on a bottom portion of said release switch; a magazine catch comprising a magazine catch bolt; a pivotable catch pivotably connected to said magazine catch bolt, wherein said pivotable catch has a first end proximal to said magazine catch bolt and a second end distal from said magazine catch bolt, wherein said release switch is removably connected to said external portion of said modified bolt catch; wherein said release switch is movable in relation to said modified bolt catch between a first position and a second position; wherein when said release switch is disposed in said first position, said magazine catch lever is disengaged from said first end of said pivotable catch; wherein when said release switch is disposed in said second position, said magazine catch lever contacts said first end of said pivotable catch; wherein when said release switch is in said second position, and a last round is fired from a magazine connected to a magazine well of said firearm, a follower in said magazine contacts said bottom side of said bolt stop portion of said modified bolt catch; wherein said modified bolt catch is configured to pivot between a first position and a second position, wherein when said modified bolt catch is in said first position, said bolt stop surface is disengaged from a bolt of said firearm and said top portion of said external portion of said modified bolt catch is positioned a substantially equal distance from an external surface of said firearm as said bottom portion of said external portion of said modified bolt catch; wherein when said modified bolt catch is in said second position, said bolt stop surface engages said bolt of said firearm and said top portion of said external portion of said modified bolt catch is further away from an external surface of said firearm than said bottom portion of said external portion of said modified bolt catch; wherein when said modified bolt catch is in said second position and said release switch is in said second position, said magazine catch lever pushes said first end of said pivotable catch and said second end of said pivotable catch disengages from a magazine in said firearm.

In another embodiment said release switch further comprises one or more ball recesses; wherein said modified bolt catch further comprises a ball bearing disposed on said external portion of said modified bolt catch; wherein said ball bearing is disposed in one of said one or more ball recesses.

In another embodiment wherein said release switch further comprises a shaped protrusion disposed on said top portion of said release switch; wherein said modified bolt catch further comprises a shaped recess disposed on a top portion of said modified bolt catch; wherein said shaped protrusion is disposed in said shaped recess;

In another embodiment the automatic magazine ejection system said shaped recess has a length with a first end and a second end; wherein said shaped protrusion has a length with a first end, a second end, and a central point disposed between said first end and said second end; wherein when said release switch is disposed in said first position, said central point of said shaped protrusion is disposed toward said first end of said shaped recess; wherein when said release switch is disposed in said second position, said central point of said shaped protrusion is disposed toward said second end of said shaped recess. Said shaped protrusion may have a channel disposed along said length.

Furthermore said modified bolt catch further comprises a locking screw having a first end and a second end, wherein said first end of said locking screw is disposed in said modified bolt catch, wherein said second end of said locking screw is disposed in said channel of said release switch.

In another embodiment said release switch further comprises one or more ball recesses wherein said modified bolt catch further comprises a ball bearing disposed on said external portion of said modified bolt catch; wherein said ball bearing is disposed in one of said one or more ball recesses.

Said pivotable catch further comprises a magazine catch protrusion disposed at said second end of said pivotable catch.

In another embodiment said release switch further comprises a first ball recess and a second ball recess, wherein said first ball recess is disposed toward a first side of said release switch, wherein said second ball recess is disposed toward a second side of said release switch.

In another embodiment said release switch further comprises one or more ball recesses; wherein said modified bolt catch further comprises a ball bearing disposed on said external portion of said modified bolt catch; wherein said ball bearing is disposed in one of said one or more ball recesses.

The automatic magazine ejection system as may further comprise a follower disposed in a magazine in a magazine well of said firearm; wherein said follower further comprises an insert block; a spring disposed in a recess of said insert block; a lateral pin disposed adjacent to said spring; wherein when a last round is fired out of said magazine, said lateral pin is disposed through an aperture in said magazine well and engages said second end of said pivotable catch.

The follower may comprise a resilient arm having a first end and a second end; wherein when a last round is fired from out of said magazine, a portion of said resilient arm is disposed through an aperture in said magazine well and engages sad second end of said pivotable catch.

A method of converting a magazine into an automatically ejected magazine is disclosed comprising removing a factory installed bolt catch from a receiver of a firearm; removing a factory installed magazine catch from said receiver of said firearm; attaching a modified bolt catch to said to said receiver of said firearm; attaching a magazine catch to said receiver of said firearm; and attaching a release switch to sad modified bolt catch.

Still other embodiments of the present invention will become readily apparent to those skilled in this art from the following description wherein there is shown and described the embodiments of this invention, simply by way of illustration of the best modes suited to carry out the invention. As it will be realized, the invention is capable of other different embodiments and its several details are capable of modifications in various obvious aspects all without departing from the scope of the invention. Accordingly, the drawing and descriptions will be regarded as illustrative in nature and not as restrictive.

BRIEF DESCRIPTION OF THE DRAWINGS

Various exemplary embodiments of this invention will be described in detail, wherein like reference numerals refer to identical or similar components, with reference to the following figures, wherein.

DETAILED DESCRIPTION OF THE PREFERRED EMBODIMENT

The claimed subject matter is now described with reference to the drawings. In the following description, for purposes of explanation, numerous specific details are set forth in order to provide a thorough understanding of the claimed subject matter. It may be evident, however, that the claimed subject matter may be practiced with or without any combination of these specific details, without departing from the spirit and scope of this invention and the claims.

The invention is an automatic release system for a firearm. The automatic release system is configured to operate such that when a firearm fires the last round in a magazine then the magazine is automatically released from the magazine well.

Figure 1:
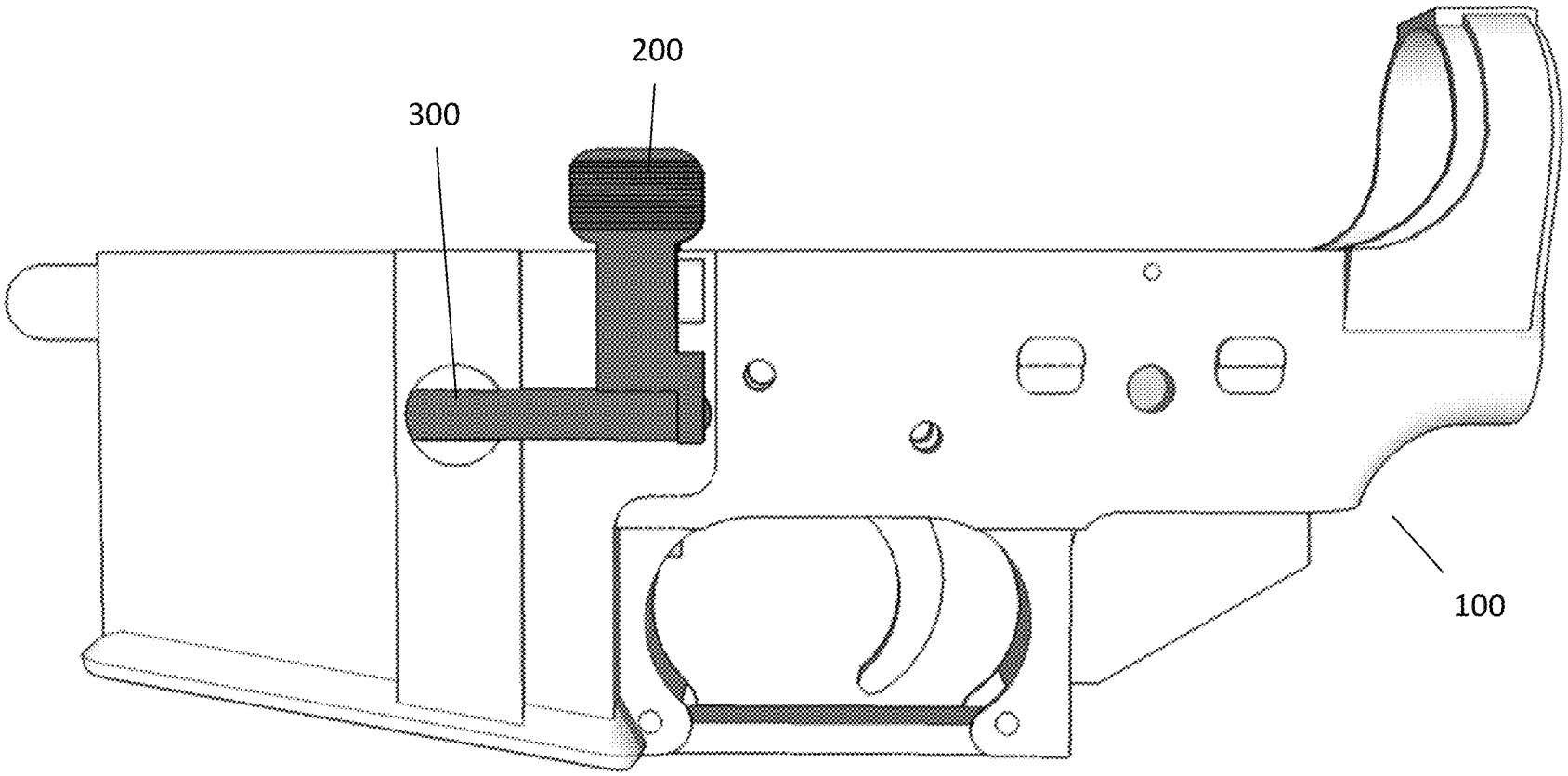
FIG. 1 is a side view of a lower receiver with the automatic release system.
Figure 2:
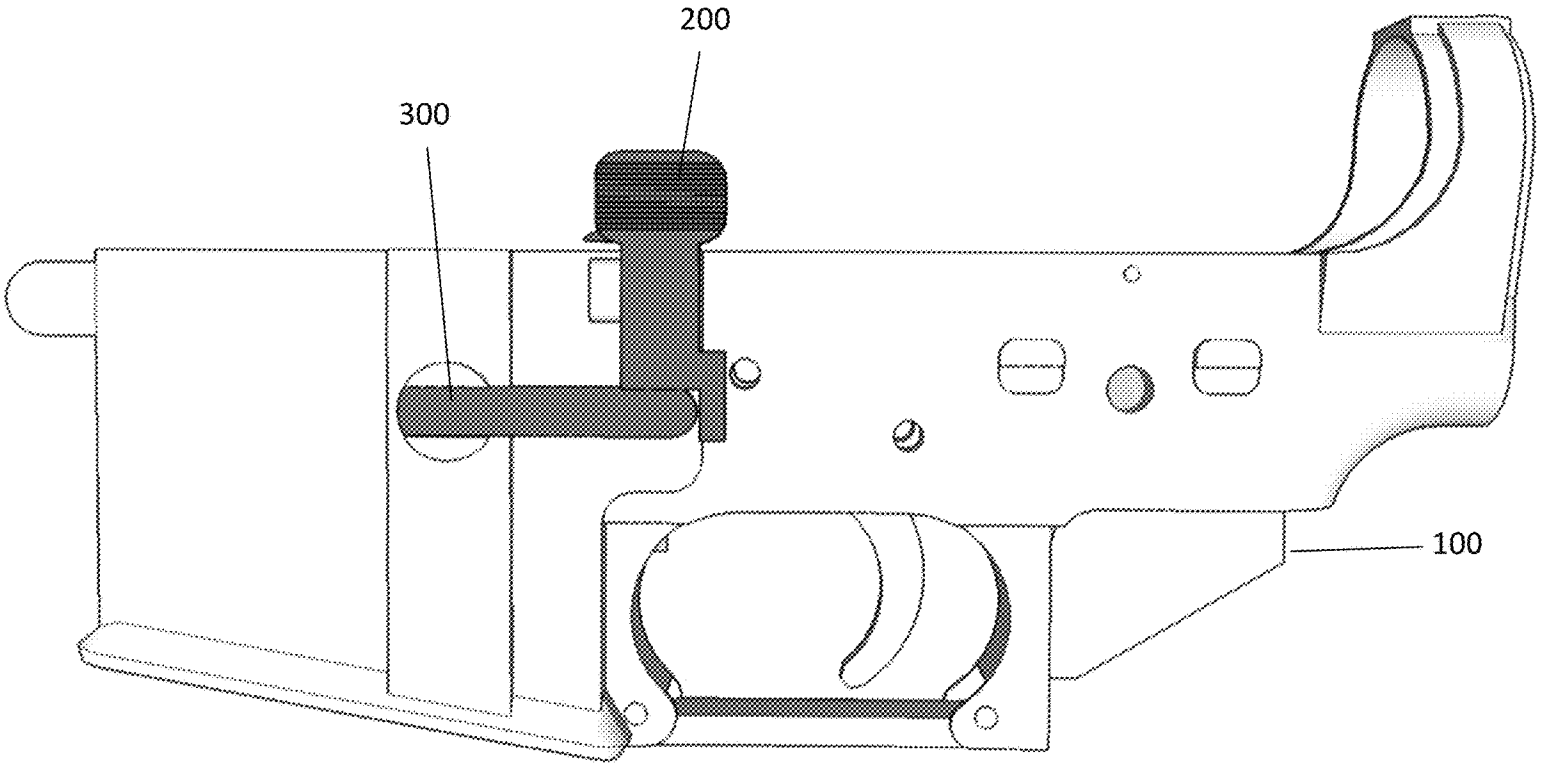
FIG. 2 is a side view of a lower receiver with the automatic release system.
Figure 3:
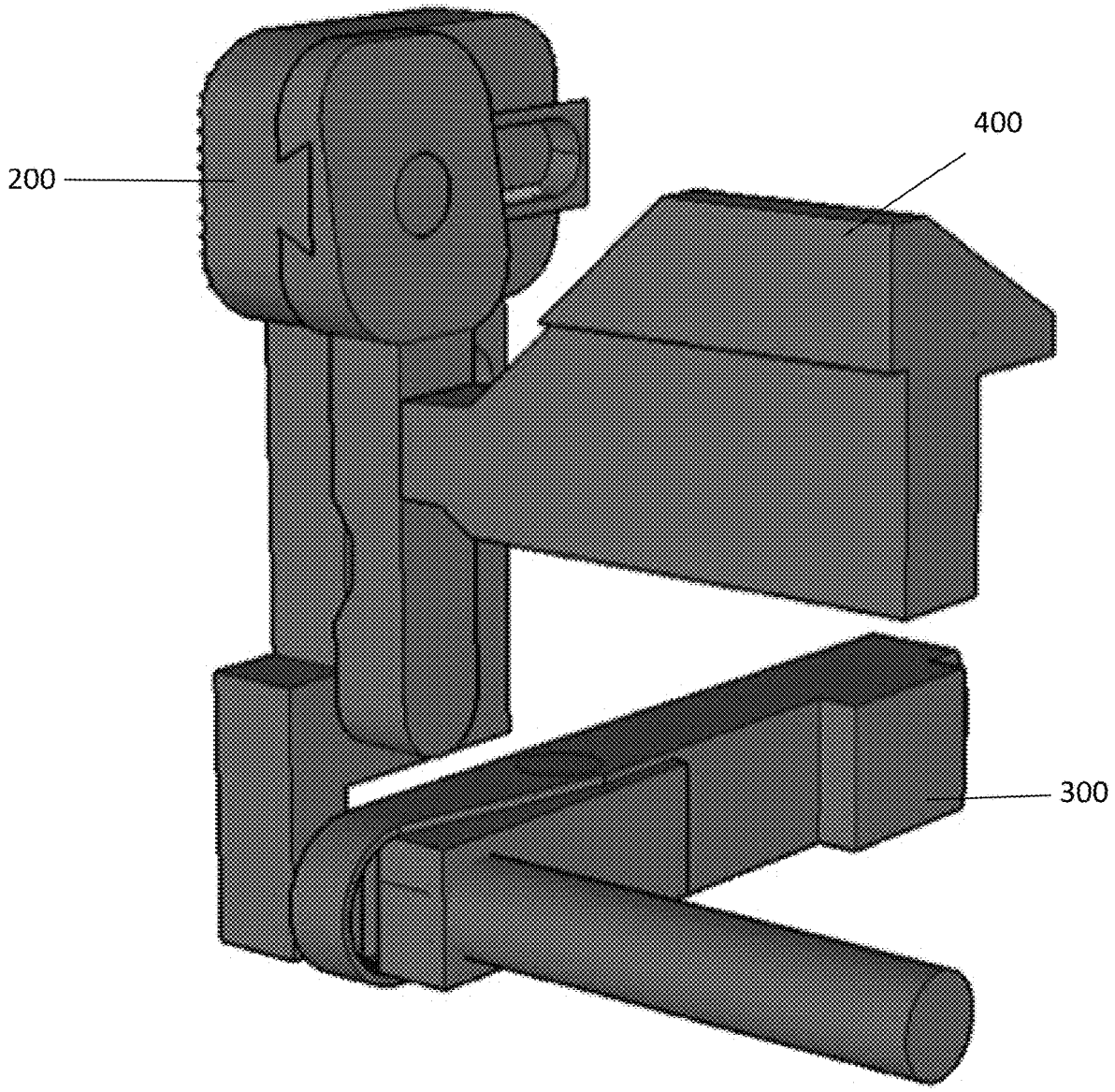
FIG. 3 is a perspective view of the automatic release system.
Figure 4:
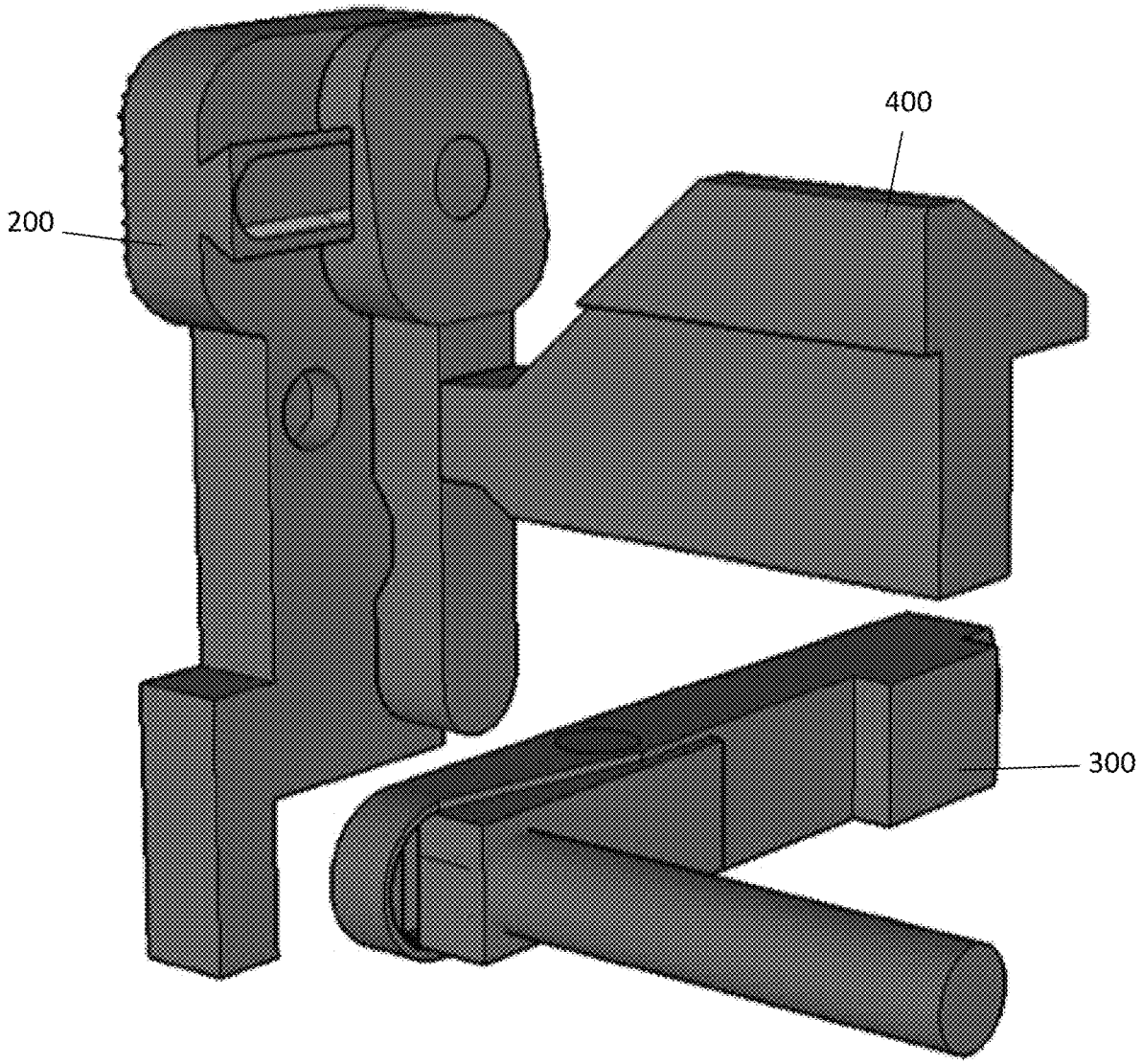
FIG. 4 is a perspective view of the automatic release system.
Figure 5:
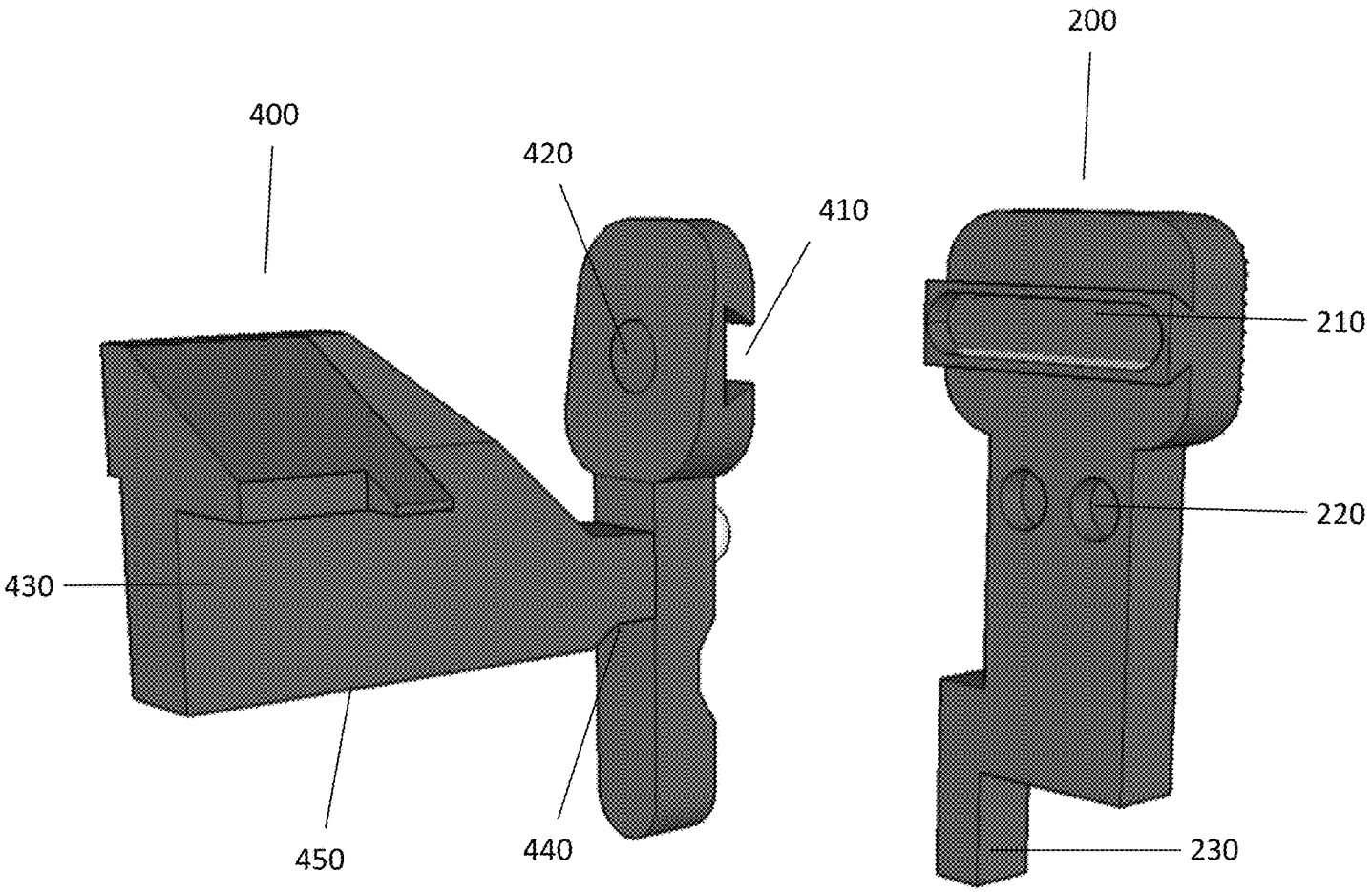
FIG. 5 is an exploded perspective view of the automatic release system.
Figure 6:
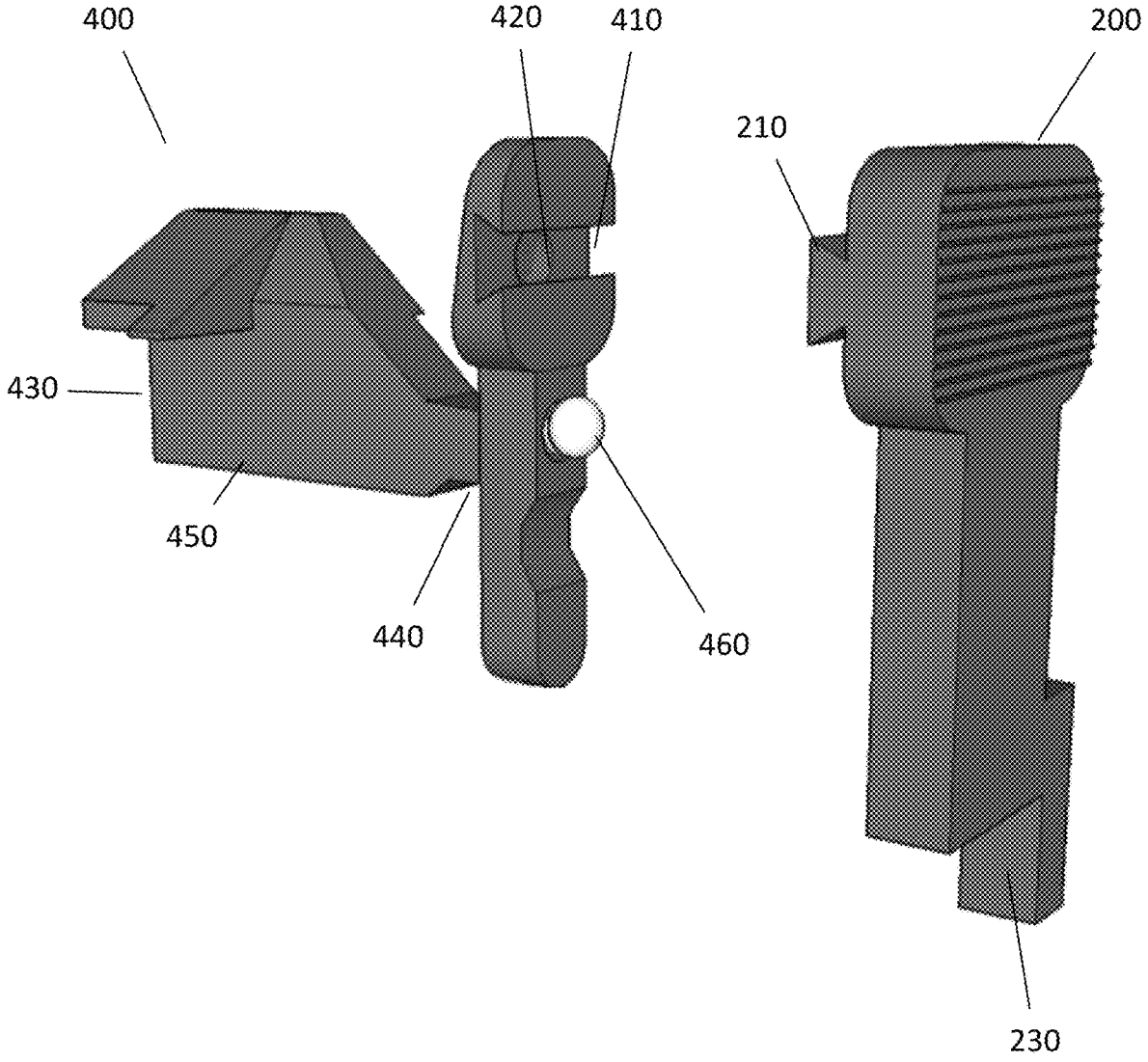
FIG. 6 is an exploded perspective view of the automatic release system.
Figure 7:
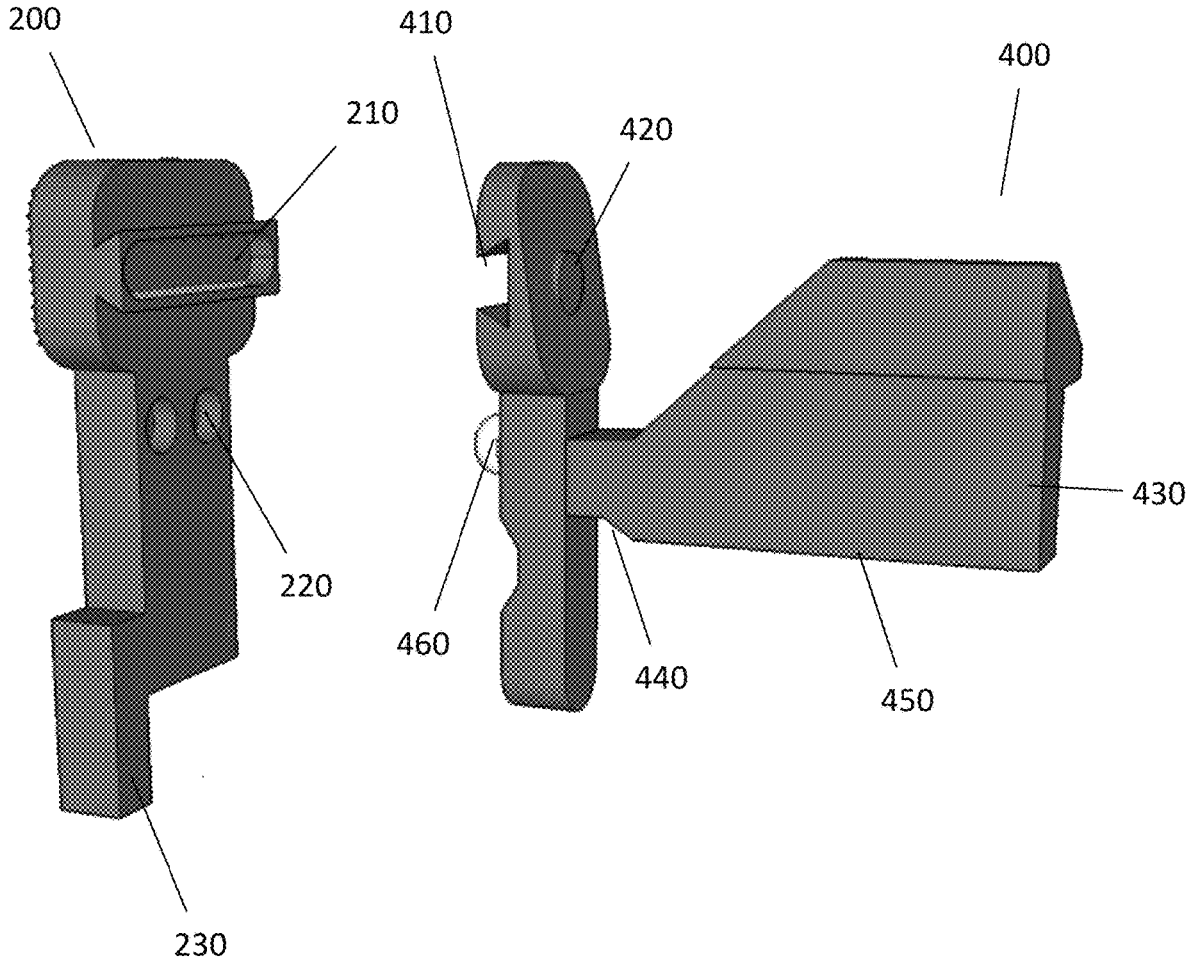
FIG. 7 is an exploded perspective view of the automatic release system.
Figure 8:
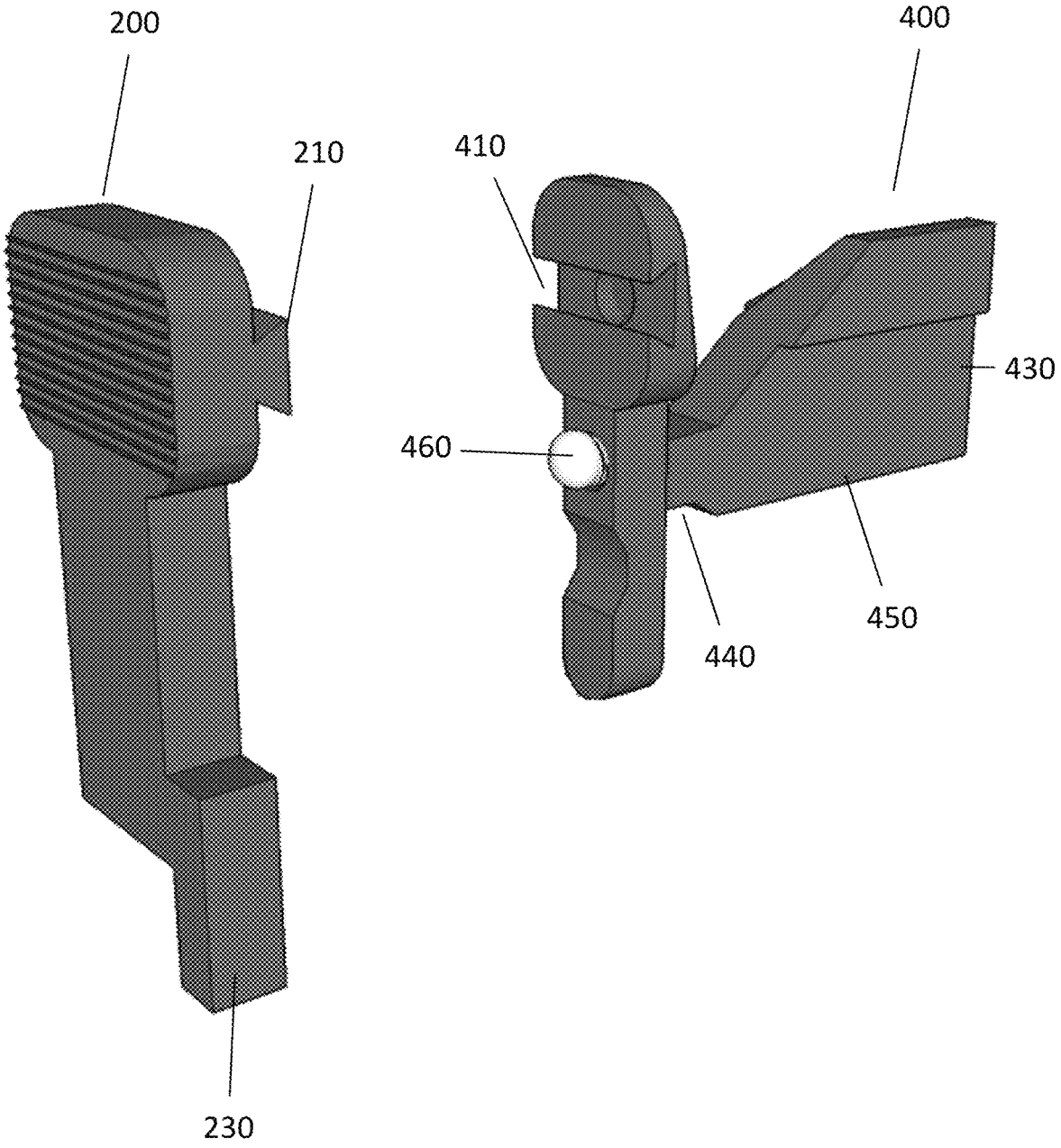
FIG. 8 is an exploded perspective view of the automatic release system.

Referring to FIG. 1 and FIG. 2, the automatic release system is displayed as mounted on the lower receiver 100 of a firearm. As shown in FIG. 3 and FIG. 4, the automatic release system comprises a release switch 200, a magazine catch 300, and a modified bolt catch 400. As shown in FIG. 1 and FIG. 3, the automatic release system is shown in the "on" position. In this position a portion of the release switch 200 engages a portion of the magazine catch 300. In this position the automatic release system is engaged and the magazine will automatically eject after the last round is fired. As shown in FIG. 2 and FIG. 4, the automatic release system is shown in the "off" position. In this position the release switch 200 does not engage the magazine catch 300.

In this position the automatic release system is disengaged and the magazine will remain attached in the magazine well after the last round is fired.

Referring to FIGS. 5-8, the preferred embodiment of the release switch 200 and modified bolt catch 400 are illustrated. The release switch 200 and the modified bolt catch 400 are movably attached together so that the release switch 200 can slide laterally along the interface with the modified bolt catch 400. When mounted, the release switch 200 can slide forward and backward along the line of firing of the receiver 100.

As shown in FIGS. 5-8, the modified release switch 200 is a solid and contiguous member. In other embodiments the release switch 200 is made up of separate components mechanically or chemically adhered together by any means, such as screws, bolts, or any type of adhesive. In the preferred embodiment, the release switch 200 is a shaped metal component comprising a top end with a shaped protrusion 210, one or more ball recesses 220, and a magazine catch lever 230. In the preferred embodiment the shaped protrusion 210 has a channel running along the length of the shaped protrusion. The channel is shaped to receive a locking screw 420 disposed in the modified bolt catch 400. The shaped protrusion 210 is shaped so that it is disposed within the shaped recess 410 of the modified bolt catch 400. The shaped protrusion 210 is configured to move from side to side in the shaped recess 410 so that the release switch 200 can move from the "on" position to the "off" position when in use. The shaped protrusion 210 and shaped recess 410 can be any size and shape provided that movement of the release switch 200 is not impeded.

The ball recesses 200 are circular recesses disposed in the body of the release switch 200. The ball recesses 220 can be any size and shape and may extend partially or completely through the body of the release switch 200. The ball recesses 220 are shaped to receive the ball bearing 460. The ball bearing 460 can be disposed in either of the ball recesses 220. In the preferred embodiment there are two ball recesses 220 but in other embodiments there may be any number of ball recesses 220. When sliding the release switch 200 from the "on" to "off" position, the ball bearing 460 is transitioned from one ball recess 220 to the other. Thus, when in the "on" position the ball bearing 460 is disposed in one ball recess 220 and when in the "off" position the ball bearing 460 is disposed in the other ball recess 220.

The modified bolt catch 400 can be made in almost any configuration. In the preferred embodiment, the modified bolt catch 400 is a solid and contiguous member. In other embodiments the modified bolt catch 400 is formed from separate components mechanically or chemically adhered together by any means, such as screws, bolts, or any type of adhesive. In the preferred embodiment, the modified bolt catch 400 is a shaped metal component where a portion of the member is disposed on external section of the receiver 100 and a portion is disposed in an internal chamber of the receiver 100. The modified bolt catch 400 has a bolt stop portion 430. The bolt stop portion 430 may be any size and shape. In the preferred embodiment the bolt stop portion 430 has a flat surface for engaging the bolt of the firearm when the firing chamber is empty. The bolt stop portion 430 has a bottom edge 450. The bottom edge 450 is engaged by a follower in a magazine after a last round is fired. The top of the follower engages the bottom edge 450 when the magazine is empty of all rounds. The bolt stop portion 430 engages the external portion of the modified bolt catch 400 at the angled connection point 440. The angled connection point 440 is an angled or narrowing section of the bolt stop portion 430. The top edge of the angled connection point 440 angles downward to a narrow point. Furthermore, the bottom edge of the angled connection point 440 angles upward from the bottom edge 450. This angled connection point 440 permits the modified bolt catch 400 to pivot at the angled connection point 440.

The modified bolt catch 400 may further comprise a locking screw 420. The locking screw 420 extends through the body of the modified bolt catch 400 and into the shaped recess 410. In the preferred embodiment the locking screw extends into the channel of the shaped protrusion 210 of the release switch 200. The locking screw 420 thereby prevents the release switch 200 from fully disengaging from the modified bolt catch 400. If the release switch is slid to the front or back of the firearm then the locking screw 420 will engage a lip at the end of the channel in the shaped protrusion 210 and prevent the release switch 200 from being removed.

The modified bolt catch may utilize a ball bearing 460. The ball bearing 460 may be any size or shape. The ball bearing 460 extends within the ball recesses 220 to ensure that the release switch 200 is disposed in predetermined positions in relation to the modified bolt catch 400. The ball bearing 460 may have a spring disposed behind the ball bearing 460 within the body of the modified bolt catch 400 to permit the ball bearing 460 to retract from the exterior surface of the modified bolt catch 400.

Figure 9:
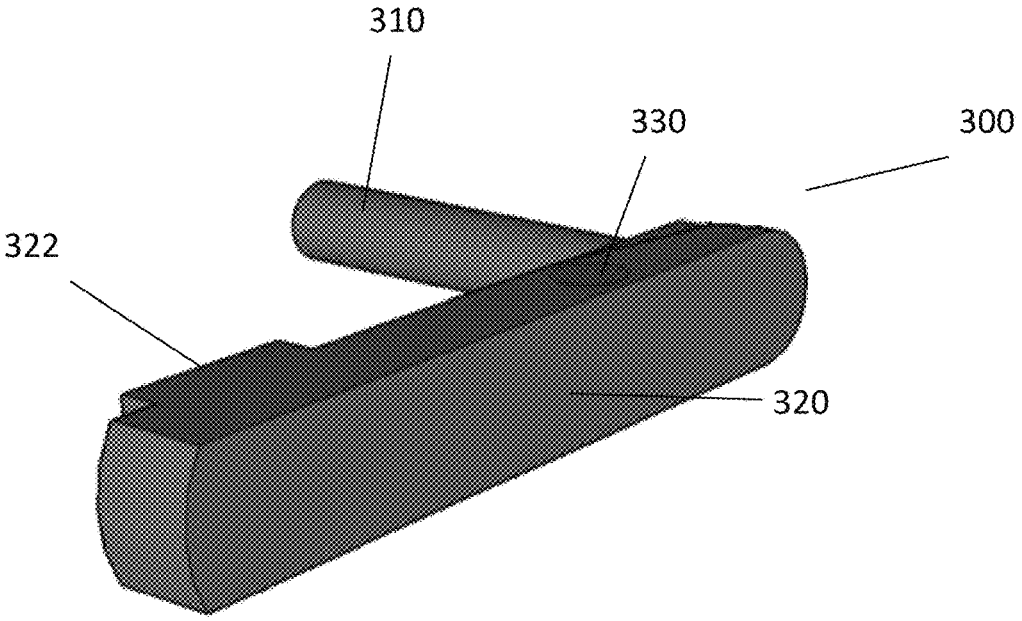
FIG. 9 is a perspective view of a magazine catch.
Figure 10:
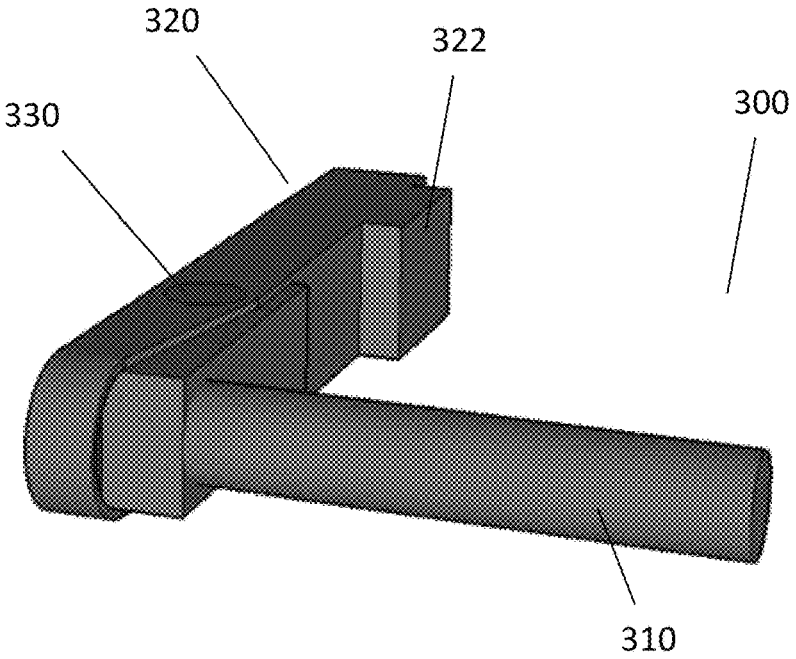
FIG. 10 is a perspective view of a magazine catch.

Referring to FIG. 9 and FIG. 10, the preferred embodiment of the magazine catch 300 is displayed. The magazine catch 300 may be any size and shape and made from any material. The magazine catch 300 comprises a magazine catch bolt 310. The magazine catch bolt 310 extends through the body of the receiver 100 to attach the magazine catch 300 to the receiver 100. The magazine catch bolt 310 has a member extending perpendicularly at the end. Connected to the magazine catch bolt 310 is a pivotable catch 320. The pivotable catch 320 is connected to the magazine catch bolt 310 by a pivot 330. The pivot 330 allows the pivotable catch 320 to move outward from the receiver 100. At the end of the pivotable catch 320 is a magazine catch protrusion 322. The magazine catch protrusion 322 extends into the wall of the magazine well in the receiver 100 to hold the magazine in place.

Figure 11:
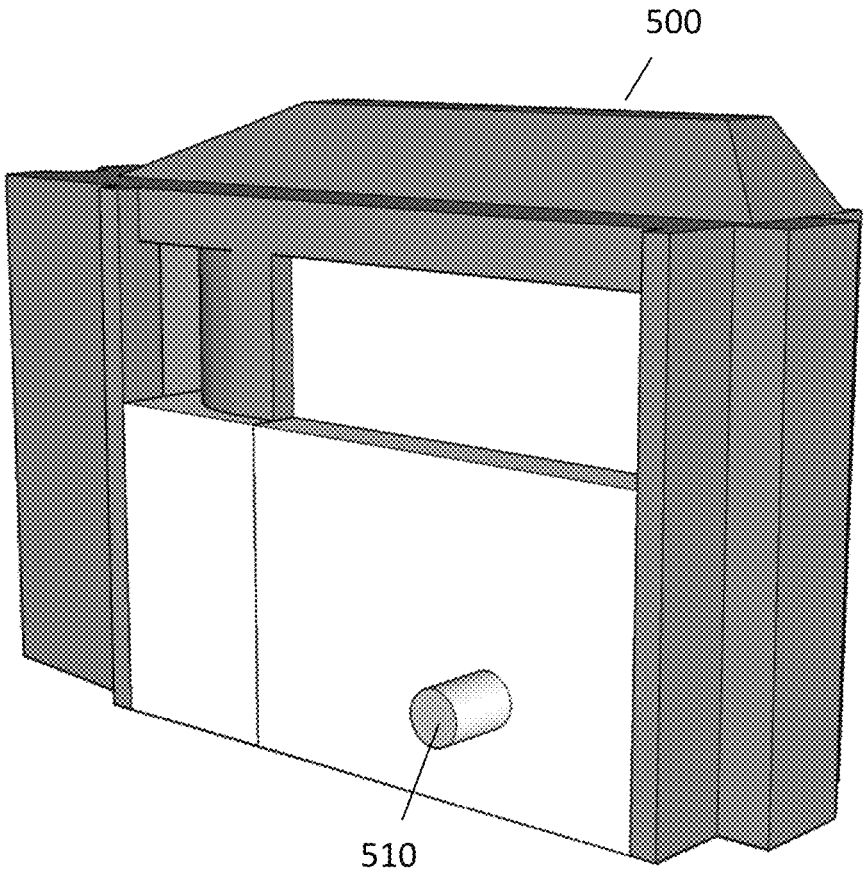
FIG. 11 is a perspective view of a magazine follower.
Figure 12:
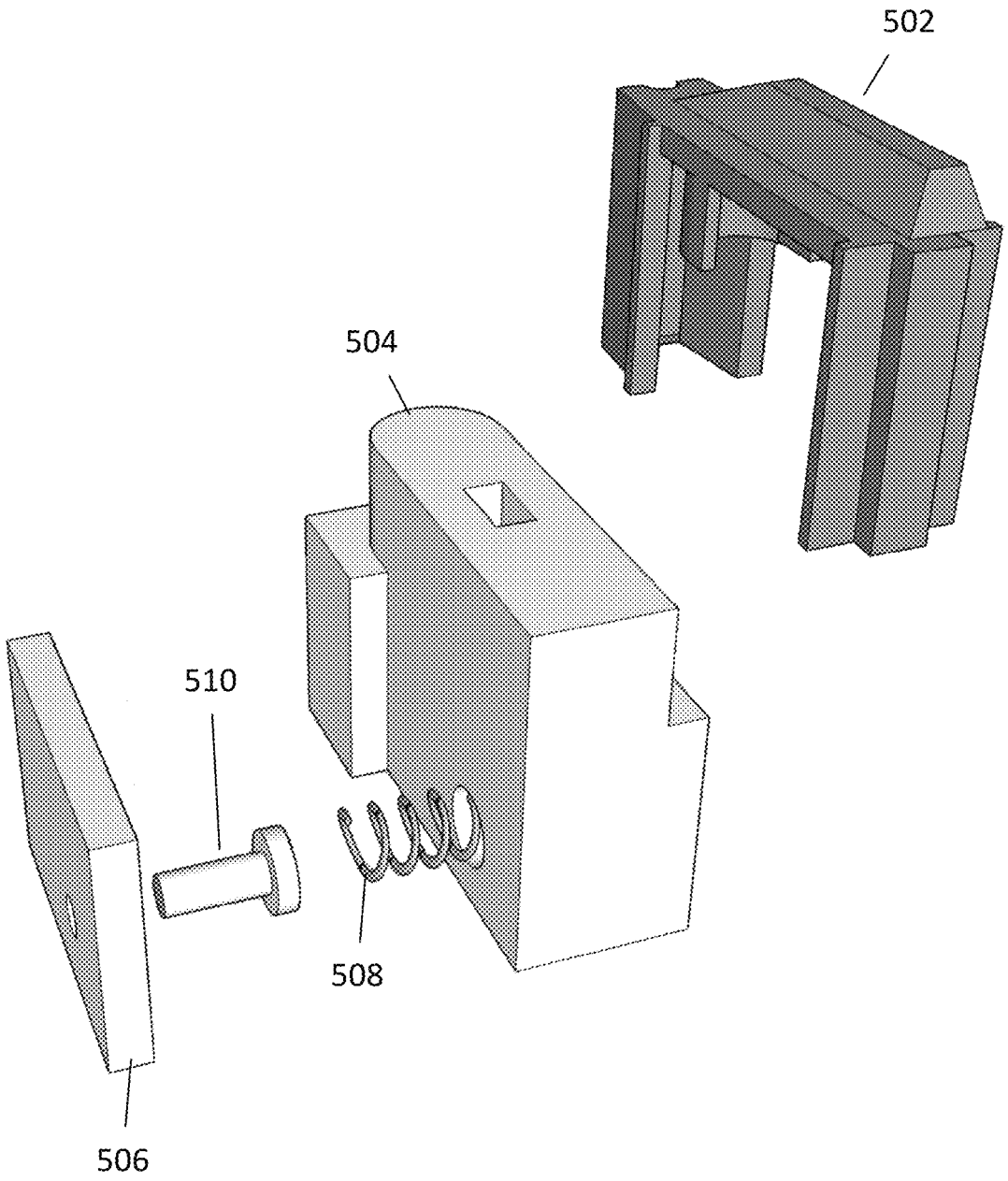
FIG. 12 is an exploded view of a magazine follower.

Referring to FIG. 11 and FIG. 12, an enhanced follower 500 is displayed. The follower 500 may be utilized with the additional components of the automatic release system. In other embodiments, the automatic release system does not utilize an enhanced follower 500 but only comprises a release switch 200, a magazine catch 300, and a modified bolt catch 400.

The follower 500 may be a single contiguous body or may be made of separate components attached together. The follower 500 may be any size and shape and may be made up of any number of components. In the preferred embodiment, the follower 500 has a lateral pin 510 extending to the side of the follower 500. The follower 500 is utilized in a magazine of a firearm. As shown in FIG. 12, the follower 500 may be made of separate components. In this embodiment the follower 500 has a top portion 502, an insert block 504, a spring 508, a pin 510, and a cover 506.

In the preferred embodiment, the insert block 504 has a lateral recess disposed one side of the insert block 504. The recess may be any size and shape. The recess houses a spring 508. The spring 508 is utilized to push a pin 510 laterally from the insert block 504. The pin 510 may be pushed toward the insert block 504, compressing the spring 508. The pin 510 may be any size and shape. In the preferred embodiment the pin 510 has a flange. The insert block system may also utilize a cover 506. The cover 506 is disposed on a lateral side of the insert block 504. The cover 506 has an aperture which is aligned with the recess of the insert block 504. The pin 510 is disposed through the cover 506. The flange of the pin 510 prevents the pin 510 from accidentally falling away from the insert block 504 and being lost.

Disposed on the top portion 502 of the follower 500 is a spacer. The spacer supports one of the two columns of cartridges in a dual stacked magazine. The spacer may be any size and shape. In the preferred embodiment the spacer is similar in shape to a cartridge and is an elongate member disposed on the top portion 502.

When the follower 500 is in use in the magazine the pin 510 engages the internal side wall of the magazine and is pushed back into the lateral recess. After the last round from the magazine is fired the pin 510 engages an aperture in the wall of the magazine. The aperture in the wall of the magazine engages the magazine catch protrusion 322 from the pivotable catch 320. When the pin 510 engages the aperture the spring 508 pushes the pin 510 outward and into the aperture in the magazine wall. The outward lateral force causes the pin 510 to force the magazine catch protrusion 322 outward from the aperture in the magazine wall. This is because the pivotable catch 320 pivots away from the lower receiver 100. Once the magazine catch protrusion 322 is disengaged from the magazine, the magazine naturally slides out of the magazine well of the lower receiver 100. The user can then insert a new magazine into the magazine well without needing to push the magazine release button on the lower receiver.

Disposed on the front side of the follower 500 is a stop recess. The stop recess may be any size and shape. The stop recess is configured to engage at least a portion of the magazine body to prevent the follower 500 from moving any further upward along the magazine toward the firearm.

Disposed on the rear side of the follower 500 is a bolt stop interface. In some embodiments the rear side is completely flat and does not have a bolt catch interface. In the preferred embodiment the bolt catch interface extends as a protrusion from the rear side. The bolt catch interface engages the bolt catch to stop the bolt in the backward position when the magazine is empty. This permits the user to insert a new magazine and load a new round from the new magazine into the chamber.

In the preferred embodiment the follower 500 has a pair of front fins and a pair of rear fins. The front fins and rear fins can be any size and shape. The front fins and rear fins engage with grooves or guiderails within the magazine to stabilize the follower 500 within the magazine during use. Alternatively, the front fins and rear fins may fit within linear recesses in the walls of the magazine. These recesses may end in a stop at the upper end so that the follower 500 is not ejected from the end of the magazine when all of the rounds have been fired. In other embodiments there may be any number of front fins and rear fins. For instance, there may be no front fin and only a rear fin, or vice versa. There may be a front fin or rear fin on only one side of the follower 500. There may be a rear fin only one side of the follower 500.

In other embodiments of the invention, the follower 500 has an internal cavity with a resilient arm. In this embodiment the resilient arm replaces the pin 510. The resilient arm terminates in a lateral protrusion. The resilient arm is disposed within the internal cavity. The resilient arm may be any size and shape. The resilient arm is configured to flex laterally such that the distal end with the lateral protrusion moves inward to the internal cavity and outward from the internal cavity. The lateral protrusion may be any size and shape. In the preferred embodiment the lateral protrusion has a triangular profile shape, although other profiles and shapes may be utilized. In the preferred embodiment the lateral protrusion extends outward from the main body of the follower 500.

When the follower 500 is in use in the magazine the lateral protrusion engages the internal side wall of the magazine and is pushed back into the internal cavity, causing the resilient arm to deform. After the last round from the magazine is fired the lateral protrusion is positioned to engage an aperture in the wall of the magazine. The aperture in the wall of the magazine engages the magazine catch from the magazine catch assembly. When the lateral protrusion engages the aperture the resilient arm returns from its deformed position to a natural position, pushing the lateral protrusion into the aperture in the magazine wall. The outward lateral force created by the resilient arm causes the lateral protrusion to force the magazine catch protrusion 322 outward from the aperture in the magazine wall. Once the magazine catch protrusion 322 is disengaged from the magazine, the magazine naturally slides out of the magazine well of the lower receiver. The user can then insert a new magazine into the magazine well without needing to push the magazine release button on the lower receiver.

In other embodiments of the invention the resilient arm comprises a hinge which permits the resilient arm to pivot laterally, moving the lateral protrusion into and out of the magazine catch aperture.

In embodiments utilizing an insert block 504 in the invention, the insert block 504 may be any size and shape. The insert block 504 is configured to fit into an underside of a follower. The insert block 504 has a front side facing the direction of fire of the firearm, a rear side facing the rear of the firearm, a top side, a bottom side, and two lateral sides. The insert block 504 may have one or more recesses in the top side into which portions of the follower may be disposed. Alternatively, the insert block 504 may have one or more protrusions extending from the top side to engage portions of the follower. The insert block 504 may be further shaped to complement the follower to ensure a complete fit to the follower such that the insert block 504 is immovable. In the preferred embodiment the top portion of the insert block has a narrower width than the bottom portion. In addition, the length of the top portion of the insert block 504 is shorter than the length of the bottom portion of the insert block 504. In other embodiments the width and length of the insert block 504 is consistent between the top portion and the bottom portion. In the preferred embodiment the front portion of the top portion of the insert block 504 is curved.

The automatic release system may be utilized in an embodiment without a follower with a pin 510. When utilized in this embodiment, after the last round is fired from the magazine, the top of the follower 500 engages the bottom edge 450 of the modified bolt catch 400, pushing the modified bolt catch 400 upward. The modified bolt catch 400 pivots at angled connection point 440. The top portion of the release switch 200 moves outward from the receiver 100 and the magazine catch lever 230 moves toward the receiver 100. When the release switch 200 is switched into the "on" position, the magazine catch lever 230 engages the pivotable catch 320. The end of the pivotable catch 320 disposed near the mag catch bolt 310 is pushed toward the receiver 100. The end of the pivotable catch 320 with the magazine catch protrusion 322 moves outward from the receiver 100. The magazine catch protrusion 322 is disposed in an aperture in the magazine well and holds the magazine within the magazine well. When the magazine catch protrusion 322 moves outward from the aperture in the magazine well, the magazine is disengaged and it automatically falls from the magazine well.

If the release switch 200 is in the "off" position then the magazine catch lever 230 does not engage the pivotable catch 320. Then the pivotable catch 320 is not moved and the magazine catch protrusion 322 remains disposed in the aperture in the magazine well and engaged with the magazine. When "off" the magazine catch protrusion 322 remains engages with the magazine and the magazine stays within the magazine well after the last round is fired.

In another embodiment, the automatic release system may utilize a follower 500 having a pin 510. In this embodiment, when there are rounds within the magazine, the spring 508 pushes the pin 510 toward the side wall of the magazine. When the last round is fired, the pin 510 is aligned with an aperture in the wall of the magazine. The pin 510 passes into the aperture in the wall of the magazine and pushes against the magazine catch protrusion 322. The spring 508 then pushes the pin 510 against the magazine catch protrusion 322.

At the same time, the top of the follower 500 engages the bottom edge 450 of the modified bolt catch 400, pushing the modified bolt catch 400 upward. The modified bolt catch 400 pivots at angled connection point 440. The top portion of the release switch 200 moves outward from the receiver 100 and the magazine catch lever 230 moves toward the receiver 100. When the release switch 200 is switched into the "on" position, the magazine catch lever 230 engages the pivotable catch 320. The end of the pivotable catch 320 disposed near the mag catch bolt 310 is pushed toward the receiver 100. The end of the pivotable catch 320 with the magazine catch protrusion 322 moves outward from the receiver 100. The magazine catch protrusion 322 is disposed in an aperture in the magazine well and holds the magazine within the magazine well. When the magazine catch protrusion 322 moves outward from the aperture in the magazine well, the magazine is disengaged and it automatically falls from the magazine well. In this embodiment, the magazine catch protrusion 322 is moved outward by both the pin 510 and the magazine catch lever 230.

The system is utilized to both automatically eject the magazine and hold the bolt back after the last round is fired. In competing products or other disclosed systems, the competing systems are not configured to hold back the bolt after the last round is fired. If a follower from another system pushes the bolt catch upward, the bolt catch is no longer pushed upward by the follower when the magazine falls out of the magazine well. This presents an issue of safety as the bolt may push forward even though the chamber is empty. The invention overcomes this problem with the modified bolt catch 400. The modified bolt catch 400 is configured to remain engaged with the bolt even after the follower 500 is disengaged when the magazine is removed from the magazine well.

What has been described above includes examples of the claimed subject matter. It is, of course, not possible to describe every conceivable combination of components or methodologies for purposes of describing the claimed subject matter, but one of ordinary skill in the art can recognize that many further combinations and permutations of such matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

The foregoing method descriptions and the process flow diagrams are provided merely as illustrative examples and are not intended to require or imply that the steps of the various embodiments must be performed in the order presented. As will be appreciated by one of skill in the art the order of steps in the foregoing embodiments may be performed in any order. Words such as "thereafter," "then," "next," etc. are not intended to limit the order of the steps; these words are simply used to guide the reader through the description of the methods. Further, any reference to claim elements in the singular, for example, using the articles "a," "an" or "the" is not to be construed as limiting the element to the singular.

The preceding description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the following claims and the principles and novel features disclosed herein.

The invention claimed is:

1. An automatic magazine ejection system for a firearm comprising a) a modified bolt catch having a bolt stop portion, an external portion, and an angled connection point connecting said bolt stop portion and said external portion;
   i) wherein said bolt stop portion is disposed in an internal chamber in a receiver of said firearm
   ii) wherein said external portion is disposed externally from said internal chamber of said firearm, said external portion having a top portion and a bottom portion;
   iii) wherein said bolt stop portion has a bottom side and a bolt surface;

b) a release switch comprising
   i) a magazine catch lever disposed on a bottom portion of said release switch;

c) a magazine catch comprising
   i) a magazine catch bolt
   ii) a pivotable catch pivotably connected to said magazine catch bolt, wherein said pivotable catch has a first end proximal to said magazine catch bolt and a second end distal from said magazine catch bolt, d) wherein said release switch is removably connected to said external portion of said modified bolt catch;

e) wherein said release switch is movable in relation to said modified bolt catch between a first position and a second position;

f) wherein when said release switch is disposed in said first position, said magazine catch lever is disengaged from said first end of said pivotable catch;

g) wherein when said release switch is disposed in said second position, said magazine catch lever contacts said first end of said pivotable catch;

h) wherein when said release switch is in said second position, and a last round is fired from a magazine connected to a magazine well of said firearm, a follower in said magazine contacts said bottom side of said bolt stop portion of said modified bolt catch;

i) wherein said modified bolt catch is configured to pivot between a first position and a second position, wherein when said modified bolt catch is in said first position, said bolt stop surface is disengaged from a bolt of said firearm and said top portion of said external portion of said modified bolt catch is positioned a substantially equal distance from an external surface of said firearm as said bottom portion of said external portion of said modified bolt catch;

j) wherein when said modified bolt catch is in said second position, said bolt stop surface engages said bolt of said firearm and said top portion of said external portion of said modified bolt catch is further away from an external surface of said firearm than said bottom portion of said external portion of said modified bolt catch;

k) wherein when said modified bolt catch is in said second position and said release switch is in said second position, said magazine catch lever pushes said first end of said pivotable catch and said second end of said pivotable catch disengages from a magazine in said firearm.

2. The automatic magazine ejection system as in claim 1 a) wherein said release switch further comprises one or more ball recesses b) wherein said modified bolt catch further comprises a ball bearing disposed on said external portion of said modified bolt catch;

c) wherein said ball bearing is disposed in one of said one or more ball recesses.

3. The automatic magazine ejection system as in claim 1 a) wherein said release switch further comprises a shaped protrusion disposed on said top portion of said release switch b) wherein said modified bolt catch further comprises a shaped recess disposed on said top portion of said modified bolt catch;

c) wherein said shaped protrusion is disposed in said shaped recess.

4. The automatic magazine ejection system as in claim 3 a) wherein said shaped recess has a length with a first end and a second end;

b) wherein said shaped protrusion has a length with a first end, a second end, and a central point disposed between said first end and said second end;

c) wherein when said release switch is disposed in said first position, said central point of said shaped protrusion is disposed toward said first end of said shaped recess;

d) wherein when said release switch is disposed in said second position, said central point of said shaped protrusion is disposed toward said second end of said shaped recess.

5. The automatic magazine ejection system as in claim 4 wherein said shaped protrusion has a channel disposed along said length.

6. The automatic magazine ejection system as in claim 5 wherein said modified bolt catch further comprises a locking screw having a first end and a second end, wherein said first end of said locking screw is disposed in said modified bolt catch, wherein said second end of said locking screw is disposed in said channel of said release switch.

7. The automatic magazine ejection system as in claim 6 a) wherein said release switch further comprises one or more ball recesses b) wherein said modified bolt catch further comprises a ball bearing disposed on said external portion of said modified bolt catch;

c) wherein said ball bearing is disposed in one of said one or more ball recesses.

8. The automatic magazine ejection system as in claim 1 wherein said pivotable catch further comprises a magazine catch protrusion disposed at said second end of said pivotable catch.

9. The automatic magazine ejection system as in claim 1 a) wherein said release switch further comprises a first ball recess and a second ball recess, wherein said first ball recess is disposed toward a first side of said release switch, wherein said second ball recess is disposed toward a second side of said release switch.

10. The automatic magazine ejection system as in claim 1 further comprising a) a follower disposed in a magazine in a magazine well of said firearm;

b) wherein said follower further comprises i) an insert block;

ii) a spring disposed in a recess of said insert block;

iii) a lateral pin disposed adjacent to said spring;

iv) wherein when a last round is fired out of said magazine, said lateral pin is disposed through an aperture in said magazine well and engages said second end of said pivotable catch.

11. The automatic magazine ejection system as in claim 1 further comprising a) a follower disposed in a magazine in a magazine well of said firearm;

b) wherein said follower further comprises a resilient arm having a first end and a second end;

c) wherein when a last round is fired from out of said magazine, a portion of said resilient arm is disposed through an aperture in said magazine well and engages sad second end of said pivotable catch.

12. A method of converting a magazine into an automatically ejected magazine comprising a) removing a factory installed bolt catch from a receiver of a firearm;

b) removing a factory installed magazine catch from said receiver of said firearm;

c) attaching a modified bolt catch to said to said receiver of said firearm;

d) attaching a magazine catch to said receiver of said firearm;

e) attaching a release switch to said modified bolt catch;

f) wherein said modified bolt catch hays a bolt stop portion, an external portion, and an angled connection point connecting said bolt stop portion and said external portion;

i) wherein said bolt stop portion is disposed in an internal chamber in a receiver of said firearm ii) wherein said external portion is disposed externally from said internal chamber of said firearm, said external portion having a top portion and a bottom portion;

iii) wherein said bolt stop portion has a bottom side and a bolt surface;

g) wherein said release switch comprises i) a magazine catch lever disposed on a bottom portion of said release switch;

h) wherein said magazine catch comprises i) a magazine catch bolt ii) a pivotable catch pivotably connected to said magazine catch bolt, wherein said pivotable catch has a first end proximal to said magazine catch bolt and a second end distal from said magazine catch bolt, i) wherein said release switch is removably connected to said external portion of said modified bolt catch;

j) wherein said release switch is movable in relation to said modified bolt catch between a first position and a second position;

k) wherein when said release switch is disposed in said first position, said magazine catch lever is disengaged from said first end of said pivotable catch;

l) wherein when said release switch is disposed in said second position, said magazine catch lever contacts said first end of said pivotable catch;

m) wherein when said release switch is in said second position, and a last round is fired from a magazine connected to a magazine well of said firearm, a follower in said magazine contacts said bottom side of said bolt stop portion of said modified bolt catch;

n) wherein said modified bolt catch is configured to pivot between a first position and a second position, wherein when said modified bolt catch is in said first position, said bolt stop surface is disengaged from a bolt of said firearm and said top portion of said external portion of said modified bolt catch is positioned a substantially equal distance from an external surface of said firearm as said bottom portion of said external portion of said modified bolt catch;

o) wherein when said modified bolt catch is in said second position, said bolt stop surface engages said bolt of said firearm and said top portion of said external portion of said modified bolt catch is further away from an external surface of said firearm than said bottom portion of said external portion of said modified bolt catch;

p) wherein when said modified bolt catch is in said second position and said release switch is in said second position, said magazine catch lever pushes said first end of said pivotable catch and said second end of said pivotable catch disengages from a magazine in said firearm.

* * * * *